US007520737B2

(12) United States Patent
Kawazoe

(10) Patent No.: US 7,520,737 B2
(45) Date of Patent: Apr. 21, 2009

(54) POSITIVE-DISPLACEMENT FLUID MACHINE

(75) Inventor: Shinji Kawazoe, Yokohama (JP)

(73) Assignee: Scroll Giken LLC, Yokohama-Shi (JP)

( * ) Notice: Subject to any disclaimer, the term of this patent is extended or adjusted under 35 U.S.C. 154(b) by 0 days.

(21) Appl. No.: 11/714,734

(22) Filed: Mar. 7, 2007

(65) Prior Publication Data

US 2007/0217935 A1 Sep. 20, 2007

(30) Foreign Application Priority Data

Mar. 14, 2006 (JP) ..... 2006-068743
Jan. 9, 2007 (JP) ..... 2007-001100

(51) Int. Cl.
*F04C 18/00* (2006.01)

(52) U.S. Cl. ..... 418/55.2; 418/55.1; 418/55.4

(58) Field of Classification Search ..... 418/55.2
See application file for complete search history.

(56) References Cited

U.S. PATENT DOCUMENTS 1,376,291 A * 4/1921 Rolkerr ..... 418/6
2,754,050 A * 7/1956 Wellington ..... 418/112
3,059,584 A * 10/1962 Cottell ..... 418/142
3,414,189 A * 12/1968 Persson ..... 418/201.2
4,028,021 A * 6/1977 Berkowitz ..... 418/56
4,054,336 A * 10/1977 Ernst et al. ..... 384/609
4,269,420 A * 5/1981 Persson ..... 277/355
4,579,512 A * 4/1986 Shiibayashi et al. ..... 418/55.2
4,645,362 A * 2/1987 Orte ..... 384/485
5,035,589 A * 7/1991 Fraser et al. ..... 418/1
RE34,413 E * 10/1993 McCullough ..... 418/55.3

* cited by examiner

*Primary Examiner*—Thomas Denion
*Assistant Examiner*—Douglas J. Duff
(74) *Attorney, Agent, or Firm*—Wenderoth, Lind & Ponack, L.L.P.

(57) ABSTRACT

The present invention is a fluid machine constituted so as to close moving spaces communicating with an intake opening by at least one pair of members, move them toward a discharge opening and discharge fluid sucked into the intake opening from the discharge opening. The members are arranged so as to form a specific clearance at a position where they are closest to each other, and a leakage prevention mechanism consisting of short fibers is provided on at least one side surface of the members closing the moving spaces.

3 Claims, 4 Drawing Sheets

POSITIVE-DISPLACEMENT FLUID MACHINE

BACKGROUND OF THE INVENTION

The present invention relates to a positive-displacement fluid machine which makes a space communicating with an intake opening closed by a pair of members engaging with each other and move to an outlet opening in order to receive fluid from the intake opening and discharge it from the outlet opening.

JP 2004-286025 A1 by the present applicant discloses a scroll type fluid machine which comprises at least a casing, a follower scroll unit constituted of at least an outer peripheral block rotatably held to the casing and a follower wrap extending helically inwardly from the outer peripheral block, a driving scroll unit comprising a driving wrap engaging with the follower wrap, a pair of end plates grasping and fixing the driving wrap and holding the follower wrap slidably and a driving shaft eccentric to the follower scroll unit and supported rotatably to the casing to rotate the end plates in order to define compression spaces together with the follower scroll unit, an intake opening communicating with the first compression space and an outlet opening formed in the driving shaft and communicating with the last compression space.

JP 4-11297 U discloses a blower comprising a centrifugal impeller having a plurality of blades provided radially between an upper shroud plate and a lower shroud plate, fixed guide vanes provided around the centrifugal impeller and a fan cover covering them, wherein short fibers are bonded circularly on a surface opposite to the upper shroud plate of the fan cover by electrostatic flocking.

For instance, in a prior scroll type fluid machine disclosed in JP 2004-286025 A, in compression spaces defined by a pair of scroll wraps and a pair of end plates grasping the scroll wraps, it is well known that it is necessary to prevent leakage from parts on which side surfaces of the scroll wraps close the compression spaces in minute gaps (RC gaps) and minute gaps (AC gaps) between top surfaces of the scroll wraps and the end plates and that this leakage greatly influences performance of the scroll fluid machine. Generally, it is said that it are preferred that RC gaps is not more than 50 μm.

Accordingly, it was necessary to increase processing accuracy and assembly accuracy of all combination parts so as to make minute gap parts (RC gaps) between side surfaces of the scroll wraps and minute gap parts (AC gaps) between the top surfaces of the scroll wraps and the end plates respectively as small as possible in the prior art. Besides, it was necessary to constitute a tip sealing and the like in order to prevent leakage in the AC gap parts. Furthermore, because damage of the wraps occurs by breaking down and seizing by contact between the scroll wraps when the aforementioned gaps are made smaller, the scroll wraps must be processed using expensive surface treatment such as hard anodized aluminum treatment and the like in order to prevent breaking down and seizing. Thus, there is a disadvantage that the scroll fluid machine itself becomes expensive by increasing accuracy of finishing in order to make the aforementioned gaps smaller, by adding sealing parts and by performing expensive surface treatment.

Besides, as disclosed in JP 4-11297 U, it is very effective to seal gaps with short fibers by electrostatic flocking.

SUMMARY OF THE INVENTION

An object of the invention is to provide a positive-displacement fluid machine which is inexpensive and has high performance since leakage of moving spaces can be prevented by arranging a pair of members defining the moving spaces so as not to come in contact with each other and by providing a leakage prevention mechanism due to electrostatic flocking of short fibers between them.

According to the present invention, the positive-displacement fluid machine is constituted to have moving spaces defined between side faces of at least one pair of members such that the moving spaces are moved from an intake toward an outlet to discharge fluid inhaled into the intake from the outlet. The pair of members are arranged so as to form a specific clearance in a portion where they are nearest to each other, and a leakage prevention mechanism consisting of short fibers is provided on a surface of one of the members defining the moving spaces. In the case of the positive-displacement fluid machine, because the compression ratio thereof becomes high and leakage speed thereof becomes fast, viscosity of air becomes large, so that a leakage prevention effect of the leakage prevention mechanism consisting of the short fibers becomes high.

It is preferred that the positive-displacement fluid machine is a scroll type fluid machine and the pair of members are scroll wraps. In other words, in a scroll type fluid machine comprising a pair of scroll wraps which are engaged with each other and a pair of end plates grasping the pair of scroll wraps, the scroll wraps defining compression spaces varied continuously by revolving the scroll wraps relatively, the scroll wraps are arranged so as to form a specific clearance between side surfaces thereof in a part where both scroll wraps are the closest with each other, and the leakage prevention mechanism is provided on a surface of one of the scroll wraps facing the other scroll wrap.

Furthermore, about the specific clearance, the scroll wraps are arranged so as to form a wide clearance (RC gap of 200 to 300 μm) so that the wraps do not come in contact with each other in a usual process and assemble accuracy in the closest part and the leakage prevention mechanism consisting of the short fibers (200 to 300 μm) by performing electrostatic flocking is provided on a right or left side end surface and an inner or outer side surface of a follower scroll wrap constituting an AC gap and an RC gap which are factors of leakage from the closed spaces. Or, electrostatic flocking consisting of short fibers (200 to 300 μm) is performed on one of an inner or outer surface and end plate surface of a drive scroll wrap, so that the same effect can be achieved.

Furthermore, the positive-displacement fluid machine may be a roots type fluid machine and the pair of members may be cocoon shaped rotors. Moreover, the positive-displacement fluid machine may be a screw type fluid machine and the pair of members may be screws.

Therefore, according to the present invention, by arranging a pair of members defining compression spaces so as to have a sufficiently wide clearance, there is no need of expensive surface treatment performed on the surfaces of the members for sealing of the moving spaces, and further by providing the leakage prevention mechanism consisting of short fibers, because leakage from the moving space can be prevented, even if processing accuracy is not increased or even if the surface treatment is not performed and a raw material such as die-casting is used as it is, performance of the positive-displacement fluid machine can be increased.

DESCRIPTION OF THE PREFERRED EMBODIMENTS

Figure 1:
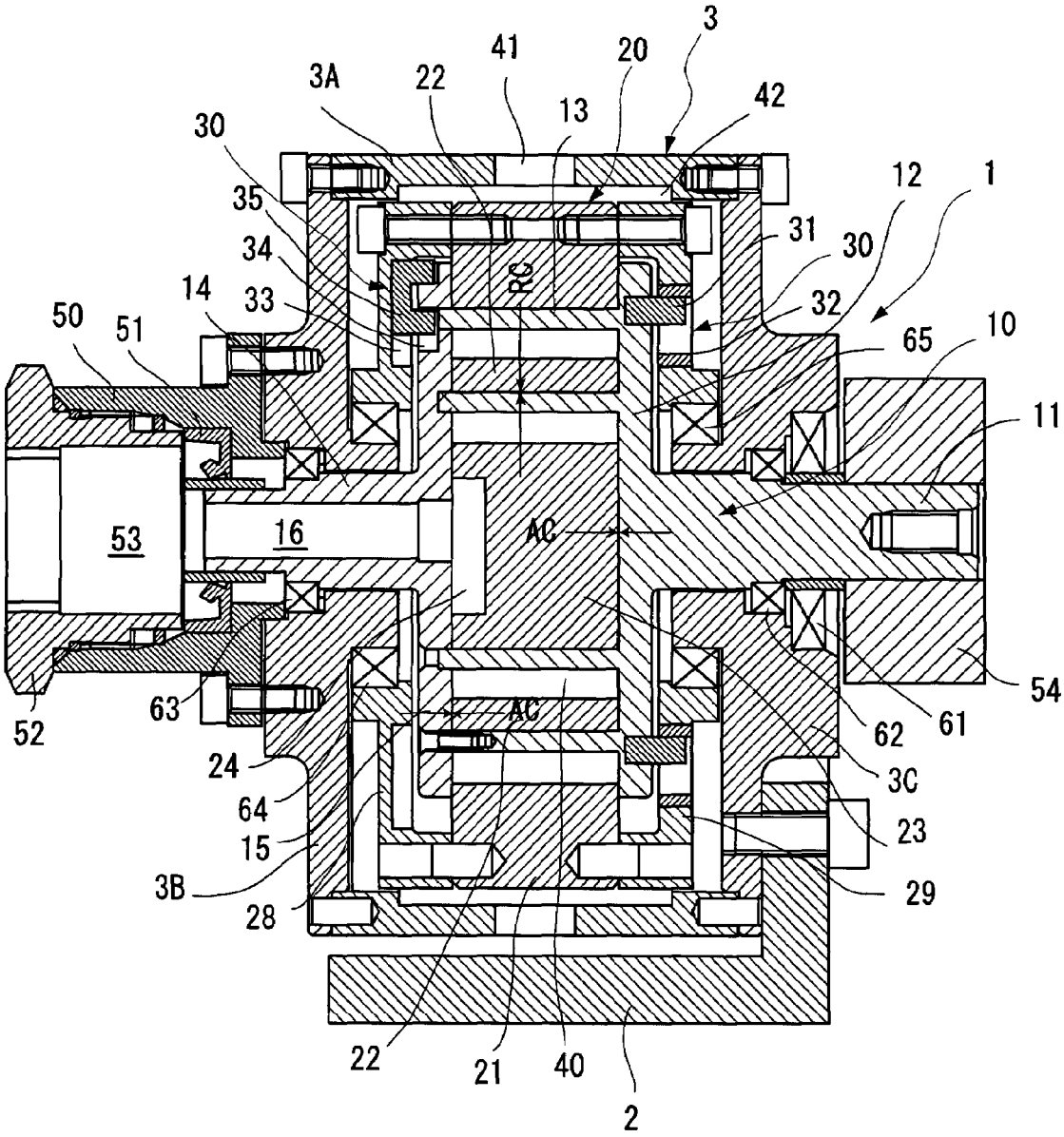
FIG. 1 is a schematic diagram of a scroll type fluid machine according to a first embodiment of the present invention.

Hereinafter, embodiments of the present invention are explained by referring to the drawings.

Figure 2:
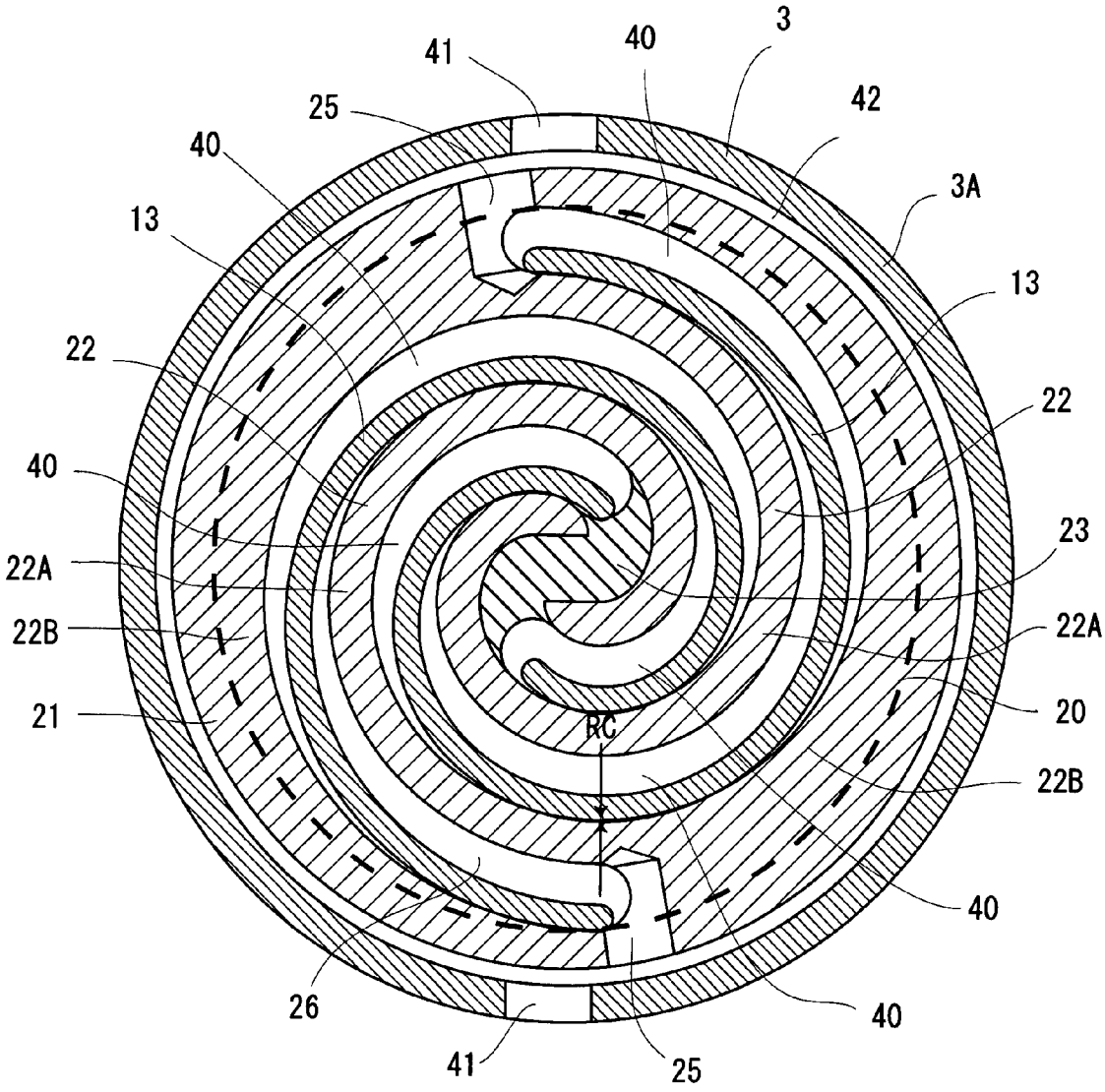
FIG. 2 is a schematic diagram showing constitution of the scroll type fluid machine according to the first embodiment of the present invention.

As shown in FIGS. 1 and 2, a scroll type fluid machine 1 as a positive-displacement fluid machine according to the present invention comprises at least a housing 3 fixed in a base 2, a first scroll unit (a drive scroll unit in this embodiment) 10 held rotatably in the housing 3, a second scroll unit (a follower scroll unit in this embodiment) 20 grasped slidably by the drive scroll unit 10 and revolved relative to the drive scroll unit 10 by rotation synchronized mechanisms 30, wherein the volume of moving spaces (compression spaces) 40 defined between side surfaces of the drive scroll unit 10 and the follower scroll unit 20 as a pair of members is reduced from an outer peripheral side to a center side gradually to perform compression action.

The housing 3 is constituted of a first cylindrical housing 3A, a second housing 3B and a third housing 3C. The first housing 3A is disposed between the second housing 3B and the third housing 3C. The second housing 3B and the third housing 3C hold the drive scroll unit 10 rotatably via bearings 62 and 63. Note that reference number 61 indicates an oil seal portion.

The drive scroll unit 10 is constituted of a first drive scroll member and a drive scroll receiver. The first drive scroll member is constituted of a rotation shaft 11 held by the third housing 3C via the bearing 62 rotatably, a first disc-like end plate 12 formed with the rotation shaft 11 unitedly and a plurality of spiral scroll wraps (drive scroll wraps) 13 formed unitedly so as to extend from the first end plate 12 axially and end at tip ends facing the second end plate, so as to be provided evenly at specific angles.

The drive scroll receiver is constituted of a support shaft 14 supported by the second housing 3B rotatably via the bearing 63 and a second disc-like end plate 15 on which the support shaft 14 is formed unitedly, wherein installation grooves in which axial end portions of the drive wraps 13 are inserted are formed on the second end plate 15 and a discharge hole 16 is provided through the support shaft 14. Note that external power is transmitted via a coupling 54 to the rotation shaft 11.

The follower scroll unit 20 is constituted of an outer peripheral ring portion 21 positioned on an outer peripheral portion thereof, a connection block portion 23 positioned in a center portion thereof, a plurality of scroll wraps (follower scroll wraps) 22 which connect between the outer peripheral ring portion 21 and the connection block portion 23 spirally and define insertion spaces 26 where the drive scroll wraps 13 are inserted. Furthermore, by inserting the drive scroll wraps 13 into the insertion spaces 26, a plurality of compression spaces 40 are defined between side surfaces of the follower scroll wraps 22 and the drive scroll wraps 13.

Besides, the follower scroll wraps 22 are constituted of block wrap portions 22B which are formed unitedly with the outer peripheral ring portion 21 along the outer peripheral ring portion 21 and in which the insertion spaces 26 are formed along inner peripheral side surfaces, extending wrap portions 22A extending spirally along the insertion spaces 26 from the block wrap portions 22B to the connection block portion 23.

Furthermore, a communication groove 24 communicating between the compression spaces 40 and the discharge hole 16 is formed in the connection block portion 23.

Moreover, the follower scroll unit 20 has a pair of scroll receivers (follower scroll receivers) 28 and 29 which are fixed adjacent to the outer peripheral ring portion 21, which are positioned outside both end plates 12 and 15 of the drive scroll unit 10 and which are supported rotatably via bearing 64 and 65 to the second and third housings 3B and 3C.

Besides, an oil seal member 51 is provided on an outer edge of the support shaft 14 and an oil seal receiving member 50 is secured on the second housing 3B. Furthermore, a cap portion 52 is provided on an end portion of the oil seal receiving member 50 and a discharge opening 53 communicating with the discharge hole 16 is formed on the cap portion 52.

The rotation synchronized mechanisms 30 are provided between the end plates 12, 15 of the drive scroll unit 20 and the follower scroll receivers 28, 29, respectively. FIG. 1 shows both cases of the rotation synchronized mechanism 30 constituted of SP pins 31 and SP rings 32 with which the SP pins are engaged and the rotation synchronized mechanism 30 constituted of Oldham grooves 34 formed on the end plates 12, 15, Oldham grooves 33 formed on the follower scroll receivers 28, 29 and Oldham sliders 35 engaging with the Oldham grooves 33, 34. In this case, any one of the rotation synchronized mechanisms 30 may be provided, or other rotation synchronized mechanisms may be provided.

According to the aforementioned constitution, as shown in FIGS. 1 and 2, gas or liquid (hereinafter, fluid) is absorbed from the intake hole 25 via an inner space 42 defined by the housing 3 from the intake opening 41 formed in the first housing 3A of the housing 3, the fluid is compressed in a restriction progression performed by moving of the compression spaces 40 to a center direction, the compressed fluid is discharged via the discharge hole 16 and the discharge opening 53 from the communication groove 24 in a center end portion.

The present invention is, as shown in FIG. 2, that the drive scroll wraps 13 and the follower scroll wraps 22 are arranged in the scroll type fluid machine 1 with the aforementioned constitution so as to form a specific RC gap when they move to a position where they are the closest to each other so as to define the compression spaces 40. However, in the case of such an arrangement, because the specific RC gap is present in the closest position, it is necessary to prevent leakage from that part. Thus, the present invention is to perform electrostatic flocking consisting of short fibers (200 to 300 μm) only on inner and outer surfaces and the left and right end surfaces of the follower scroll wraps, as a leakage prevention mechanism for preventing leakage from the RC gap and the AC gap which is a factor of leakage from the compression spaces 40. Note that length of the short fibers (200 to 300 μm), a size of the RC gap and a size of the AC gap may be different due to a size of the fluid machine or other factors.

Figure 3:
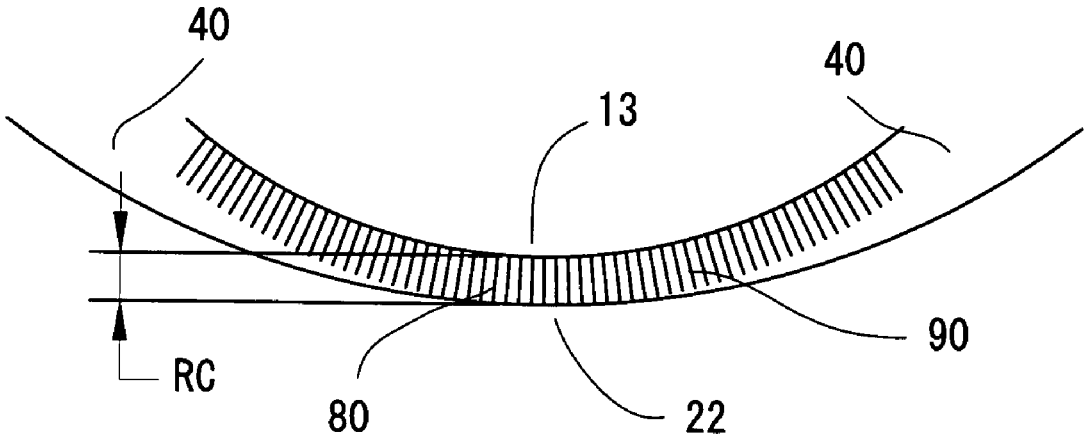
FIG. 3 is an enlarged diagram of a clearance part according to the first embodiment of the present invention.

Especially, FIG. 3 shows that short fibers 90 (200 to 300 μm) transplanted at specific density are provided on an outer side surface of the follower scroll wraps 22 so as to project into the RC gap as the leakage prevention mechanism. It is preferred that the short fibers 90 are transplanted (adhered) by electrostatic flocking. In this embodiment, even if the scroll wraps are constituted so as to have a wide gap between them, the short fibers 90 can close the wide gap, and even if the gap becomes smaller, an effect such that the short fibers 90 can close the gap without resistance by plasticity of the short fibers can be obtained.

Furthermore, in the aforementioned first embodiment, the present invention is, as shown in FIG. 1, that a specific AC gap is provided between the follower scroll wraps 22 and the first and second end plates 12, 14 and the short fibers are transplanted and adhered on both sides or one side of the follower scroll wraps 22 so as to close the AC gap. Thus, even if a tip seal which was necessary is omitted, a sufficient sealing effect can be obtained by a sealing effect of the short fibers. Furthermore, because resistance to slip by the chip seal is removed, an effect of power cutback can be expected.

Figure 4:
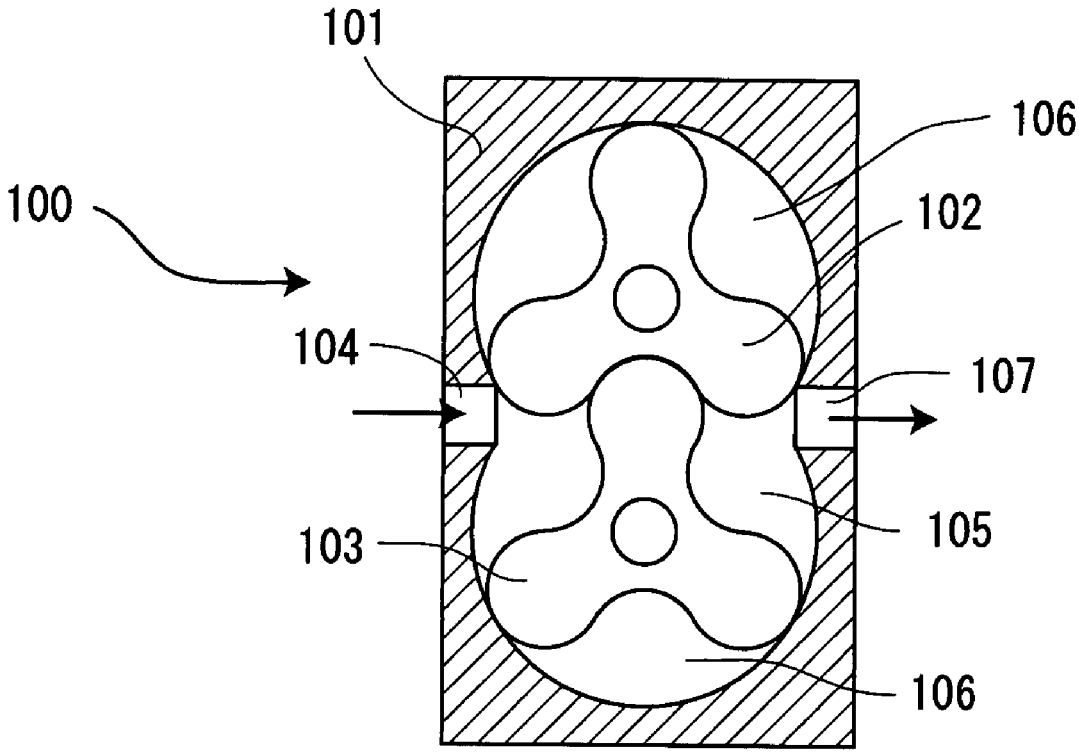
FIG. 4 is a schematic diagram showing constitution of the roots type fluid machine according to a second embodiment of the present invention.

As shown in FIG. 4, in a second embodiment, a roots type fluid machine 100 is constituted so that a pair of cocoon-like rollers 102, 103 are arranged in a space 105 formed in a housing 101, moving spaces 106 communicating with an intake opening 104 is closed and moved to a discharge openings 107 and fluid (gas or liquid) sucked from the intake opening 104 is discharged from the discharge opening 107.

Figure 5:
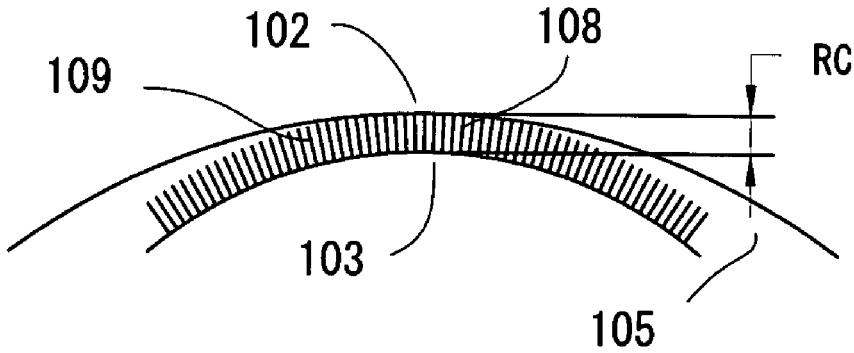
FIG. 5 is an enlarged diagram of a clearance part according to the second embodiment of the present invention.

The pair of cocoon-like rollers 102, 103 of the roots type fluid machine are arranged so as to form a specific clearance at a position where the rollers 102, 103 are the closest to each other and to provide a leakage prevention mechanism 109 consisting of short fibers 108 on a side surface of one of the cocoon-like rollers 102, 103 closing the moving spaces 106, as shown in FIG. 5.

As described above, because the present invention can be adopted in a fluid machine which is constituted so as to close moving spaces communicating with an intake opening by at least one pair of members and move them to a discharge opening in order to discharge the fluid sucked from the intake opening to the discharge opening, the leakage prevention mechanism consisting of short fibers by electrostatic flocking can be provided on an outer surface of one of the screws in a screw type fluid machine.

The fluid machine with the aforementioned constitution can compress and discharge air by communicating the intake opening to the air, so that it can be used as an air pump. Furthermore, it can be used in a water-drops scattering system and the like as an air blower.

Besides, the fluid machine according to the present invention can be used as an oil pump, a water pump, a vacuum pump or the like which sucks and discharges liquid and the like by providing a piping to the intake opening.

Moreover, because members defining the compression space do not come in contact with each other since they have specific clearance between them, noises are decreased, so that the fluid machine according to the present invention can be used in an electrical appliance.

What is claimed is:

1. A positive-displacement fluid machine constituted by a scroll compressor comprising:

a housing;

a drive scroll unit held rotatably in said housing; and a follower scroll unit grasped slidably by said drive scroll unit so as to be revolved relative to said drive scroll unit;

wherein said drive scroll unit comprises a first drive scroll member and a drive scroll receiver;

wherein said first drive scroll member comprises a rotation shaft held rotatably by said housing, a first disc-shaped end plate formed unitedly with said rotation shaft, and a plurality of drive scroll wraps formed unitedly with said first end plate, said drive scroll wraps having first and second axially opposed ends, with said first ends of said drive scroll wraps constituting base ends disposed at said first end plate and with said second ends of said drive scroll wraps constituting distal tip ends, said drive scroll wraps extending axially from said base ends thereof at said first end plate to said distal tip ends;

wherein said drive scroll receiver comprises a support shaft supported rotatably by said housing, a second disc-shaped end plate formed unitedly on said support shaft and having installation grooves formed therein, said distal tip ends of said drive scroll wraps being received in said installation grooves of said second end plate;

wherein said follower scroll unit comprises an outer peripheral ring portion positioned at an outer periphery of said follower scroll unit, a connection block portion positioned in a center portion of said outer peripheral ring portion, and follower scroll wraps connecting spirally between said outer peripheral ring portion and said connection block portion so as to define insertion spaces;

wherein said drive scroll wraps have axially-extending side faces extending between said base ends and said distal tip ends thereof;

wherein said follower scroll wraps have first and second axially opposed ends, and axially-extending side surfaces extending between said first and second axially opposed ends thereof;

wherein said drive scroll wraps are respectively disposed in said insertion spaces so that said side surfaces of said drive scroll wraps and said side surfaces of said follower scroll wraps face each other, respectively, and so that compression spaces are defined between said drive scroll unit and said follower scroll unit and are reduced from an outer peripheral side toward a center side to perform compression action;

wherein a clearance is formed between said side surfaces of said drive scroll wraps and said side surfaces of said follower scroll wraps; and wherein a leakage prevention mechanism is provided in said clearance, said leakage prevention mechanism comprising fibers on said side surfaces of said follower scroll wraps such that said fibers extend into said clearance.

2. A positive displacement fluid machine according to claim 1, wherein said fibers are constituted by electrostatically-flocked fibers such that said fibers are adhered to said at least one of said side surfaces of one of said first and second scroll wraps.

3. A positive displacement fluid machine according to claim 1, wherein said first scroll wrap has a fluid inlet opening formed therein; and a fluid discharge opening is formed in said second rotation shaft.

* * * * *